US007265718B2

(12) United States Patent
Tsai

(10) Patent No.: US 7,265,718 B2
(45) Date of Patent: Sep. 4, 2007

(54) COMPACT MULTIPLE-FREQUENCY Z-TYPE INVERTED-F ANTENNA

(75) Inventor: Feng-Chi Eddie Tsai, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 9 days.

(21) Appl. No.: 11/306,918

(22) Filed: Jan. 17, 2006

(65) Prior Publication Data

US 2007/0164906 A1 Jul. 19, 2007

(51) Int. Cl.
*H01Q 1/38* (2006.01)
*H01Q 9/16* (2006.01)

(52) U.S. Cl. ..... 343/700 MS; 343/793; 343/795

(58) Field of Classification Search ..... None
See application file for complete search history.

(56) References Cited

U.S. PATENT DOCUMENTS 5,229,782 A * 7/1993 Hemmie et al. ..... 343/795
6,509,882 B2 * 1/2003 McKivergan ..... 343/818
6,765,539 B1 7/2004 Wang et al. ..... 343/795
6,864,842 B2 * 10/2004 Hung et al. ..... 343/700 MS
7,136,018 B2 * 11/2006 Iguchi et al. ..... 343/702
2002/0163470 A1 * 11/2002 Nagumo et al. ..... 343/700 MS
2004/0108955 A1 * 6/2004 SjoBlom ..... 343/700 MS
2004/0145522 A1 * 7/2004 Wang et al. ..... 343/700 MS
2004/0233110 A1 * 11/2004 Hung et al. ..... 343/700 MS
2007/0001922 A1 * 1/2007 Song et al. ..... 343/795
2007/0024503 A1 * 2/2007 Tsai et al. ..... 343/700 MS
2007/0069964 A1 * 3/2007 Hoshiai et al. ..... 343/713

* cited by examiner

*Primary Examiner*—Trinh Vo Dinh
(74) *Attorney, Agent, or Firm*—Winston Hsu

(57) ABSTRACT

A compact multiple-frequency Z-type Inverted-F antenna includes a dielectric substrate having a horizontal axis and a vertical axis perpendicular to the horizontal axis. A feed point is disposed along the horizontal axis on a first side of the vertical axis and a ground strip is disposed along the horizontal axis on a second side of the vertical axis opposite the feed point. A plurality of wedge-shaped radiating traces is arranged symmetrically with respect to the horizontal axis and disposed on the first side of the vertical axis. A plurality of wedge-shaped ground traces symmetrical to the plurality of radiating traces with respect to the vertical axis are disposed on the second side of the vertical axis.

3 Claims, 9 Drawing Sheets

COMPACT MULTIPLE-FREQUENCY Z-TYPE INVERTED-F ANTENNA

BACKGROUND OF THE INVENTION

1. Field of the Invention

This invention relates generally to antennas and more specifically to the structure of a multiple-frequency Z-type Inverted-F antenna of small size and improved gain.

2. Description of the Prior Art

Following the consumer driven trend towards smaller wireless communications devices, there is an ongoing need of increased miniaturization and increased functionality of antennas. Aside from manufacturing and assembly concerns, complicating the design process is the additional necessity of good gain performance for each of two or more frequencies, each having omni-directional radiation patterns, for convenient and reliable transmission and reception in today's wireless world.

Although many designs have been presented to solve these problems, they are still of a relatively large size, difficult to reproduce accurately, highly directional, suffer poor gain performance, especially in the 5 GHz area range, and/or offer narrow Voltage Standing Wave Ratio (VSWR) bandwidths amongst the frequencies.

SUMMARY OF THE INVENTION

It is therefore a primary objective of the claimed invention to disclose an omni-directional, planar multiple-frequency Z-type Inverted-F antenna of small size and improved gain, at a reduced cost, and with increased durability, repeatability, and reliability to solve the above stated problems.

A multiple-frequency antenna according to the claimed invention is printed on a dielectric substrate having a horizontal axis and a vertical axis perpendicular to the horizontal axis. A feed point is disposed along the horizontal axis on a first side of the vertical axis. A variable ground strip is formed along the horizontal axis on a second side of the vertical axis opposite the feed point. A plurality of radiating traces is formed on the first side of the vertical axis and is arranged symmetrically with respect to the horizontal axis. Each radiating trace is wedge-shaped, tapered such that a narrowest end of each radiating trace is nearest the feed area. A plurality of wedge-shaped ground traces is disposed on the second side of the vertical axis and is symmetrical to the plurality of radiating traces with respect to the vertical axis.

An array of antennas is also disclosed to further enhance gain. Such an array includes a plurality of antennas according to the claimed invention formed on a single dielectric substrate. All radiating traces are formed on one side of the substrate and all ground traces are formed on the other side of the substrate, such that the substrate lies in-between the layer of radiating traces and the layer of ground traces. A conductive strip electrically connects the feed points of adjacent antennas, and a ground strip connects the ground areas of adjacent antennas, allowing simple connection of all antennas in the array with a single feeding cable.

The claimed multiple-frequency antenna utilizes a wedge-shaped components structure that enables better impedance matching and demonstrates better bandwidth characteristics in a compact multiple-frequency antenna. A printed circuit is utilized for components giving high repeatability and reliability. Excellent omni-directional radiation patterns, high gain performance, and a wide impedance or VSWR bandwidth is achieved.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
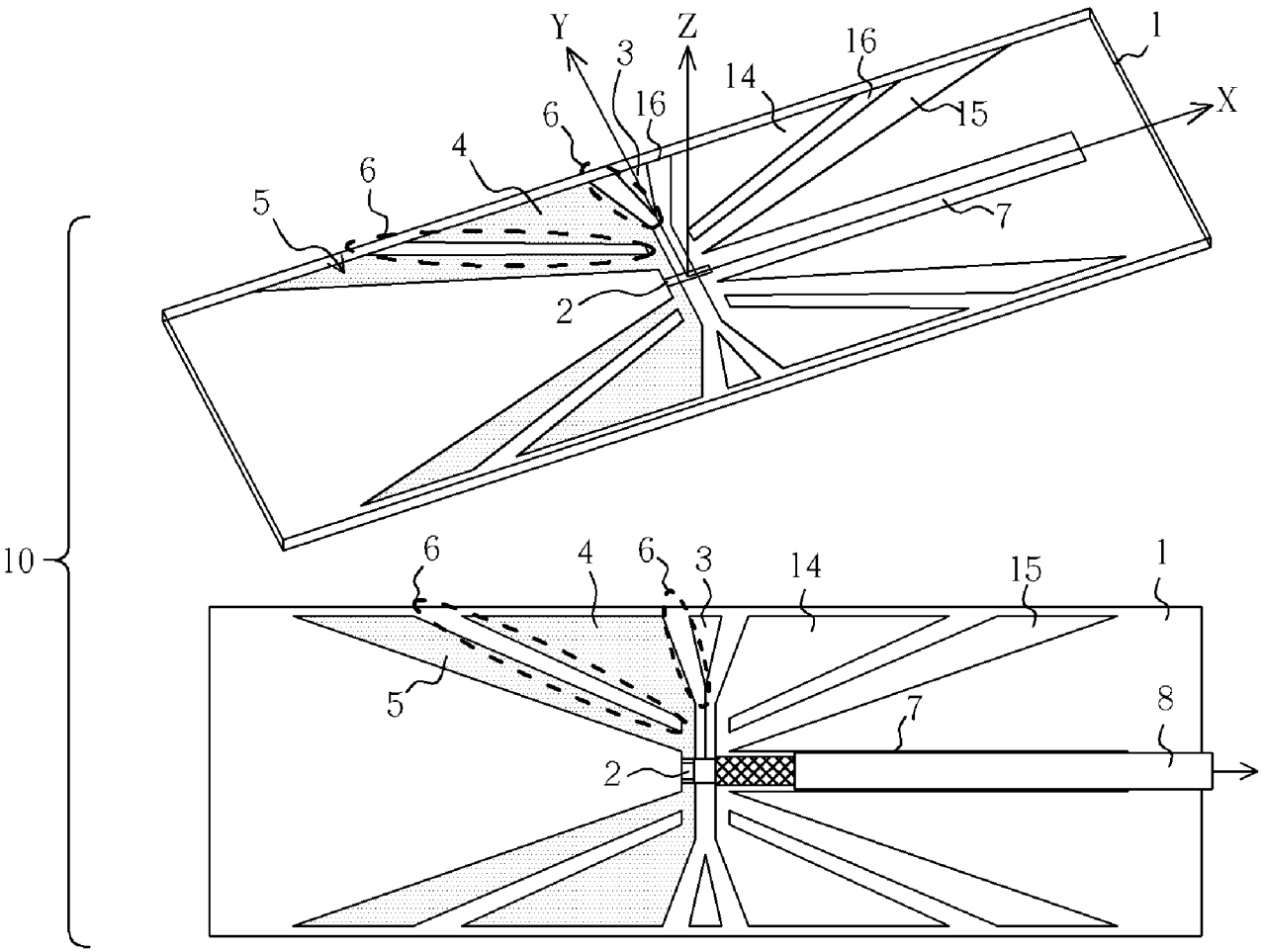
FIG. 1 is diagram of a multiple-frequency Inverted-F antenna according to the present invention.

Please refer to FIG. 1 illustrating a multiple-frequency antenna 10 according to the present invention. The antenna 10 is formed, preferably printed, on a dielectric substrate 1 having a horizontal axis and a vertical axis perpendicular to the horizontal axis. Although horizontal and vertical are perspective terms, here they are intended to mean, in the case of the bottom portion of FIG. 1, the horizontal axis extends left and right across the substrate 1 and the vertical axis extends up and down across the substrate 1. Substrate size is not to be considered limiting but is suggested to be approximately 50 mm by 17 mm to achieve best results.

A feed point 2 is disposed along the horizontal axis to the left of the vertical axis and is part of a feeding area shown as the small rectangular strip formed parallel with, and to the left of the vertical axis. A variable ground strip 7 is formed along the horizontal axis on the right side of the vertical axis opposite from the feed point 2 for radiation pattern and gain level enhancements. An extension of the ground strip is a ground area shown as the small rectangular strip formed parallel with, and to the right of the vertical axis.

A plurality of radiating traces 4, 5 is formed on the left side of the vertical axis and is arranged symmetrically with respect to the horizontal axis as shown; with one radiation trace 4 and one radiation trace 5 each symmetrically disposed on each side of the horizontal axis. Each radiating trace 4, 5 is more or less wedge-shaped, the edges of each radiating trace 4, 5 forming a substantially obtuse triangle, tapered such that a narrowest end of each radiating trace 4, 5 is nearest to, and attached to, the feed area and the width of the radiating trace 4, 5 generally increases with distance from the feed area as shown, According to design considerations, performance of the antenna 10 may be altered by having at least one of the corners of the obtuse triangle not sharpen to a point, but rather be blunted, rounded, ovaled, or squared. Between the radiating traces 4, 5 is a variable wedge-shaped gap 6 exposing the surface of the substrate for impedance matching. Edges of each gap 6 are also tapered such that a narrowest end of each gap 6 is nearest to the feed area and the width of the gap 6 generally increases with distance from the feed, Exact shapes and dimensions of the radiating traces 4, 5, and the gaps 6, are largely dependant upon desired frequency bands and cost and size considerations, but should be readily apparent to one skilled in the art.

Because the size and shape of a radiator corresponds to a resonant frequency band (one-quarter wave-length preferred) and each radiating trace 4 and 5 is responsible for a single frequency band, overall miniaturization of the antenna 10 is maximized by arranging the radiating traces such that an obtuse angle formed by two of the edges of the wedge-shaped radiating trace 4 is smaller and nearer to the vertical axis than an obtuse angle formed by two of the edges of the wedge-shaped radiating trace 5. This arrangement results in the radiating trace 4 having a shorter overall length than the radiating trace 5, and corresponds to radiating trace 4 having a higher frequency band than radiating trace 5, providing multiple frequency radiations in a minimum of substrate area.

A plurality of wedge-shaped ground traces 14, 15 is disposed on the right side of the vertical axis of the substrate 1 and is symmetrical to the plurality of radiating traces 4, 5 with respect to the vertical axis. As can be easily seen in FIG. 1, ground traces 14 symmetrically correspond to radiating traces 4 and ground traces 15 symmetrically correspond to radiating traces 5. The ground traces 14, 15 are connected to the ground area and have variable gaps 16 between them similar in shape and function to the variable gaps 6 between the radiating traces 4, 5.

Figure 7:
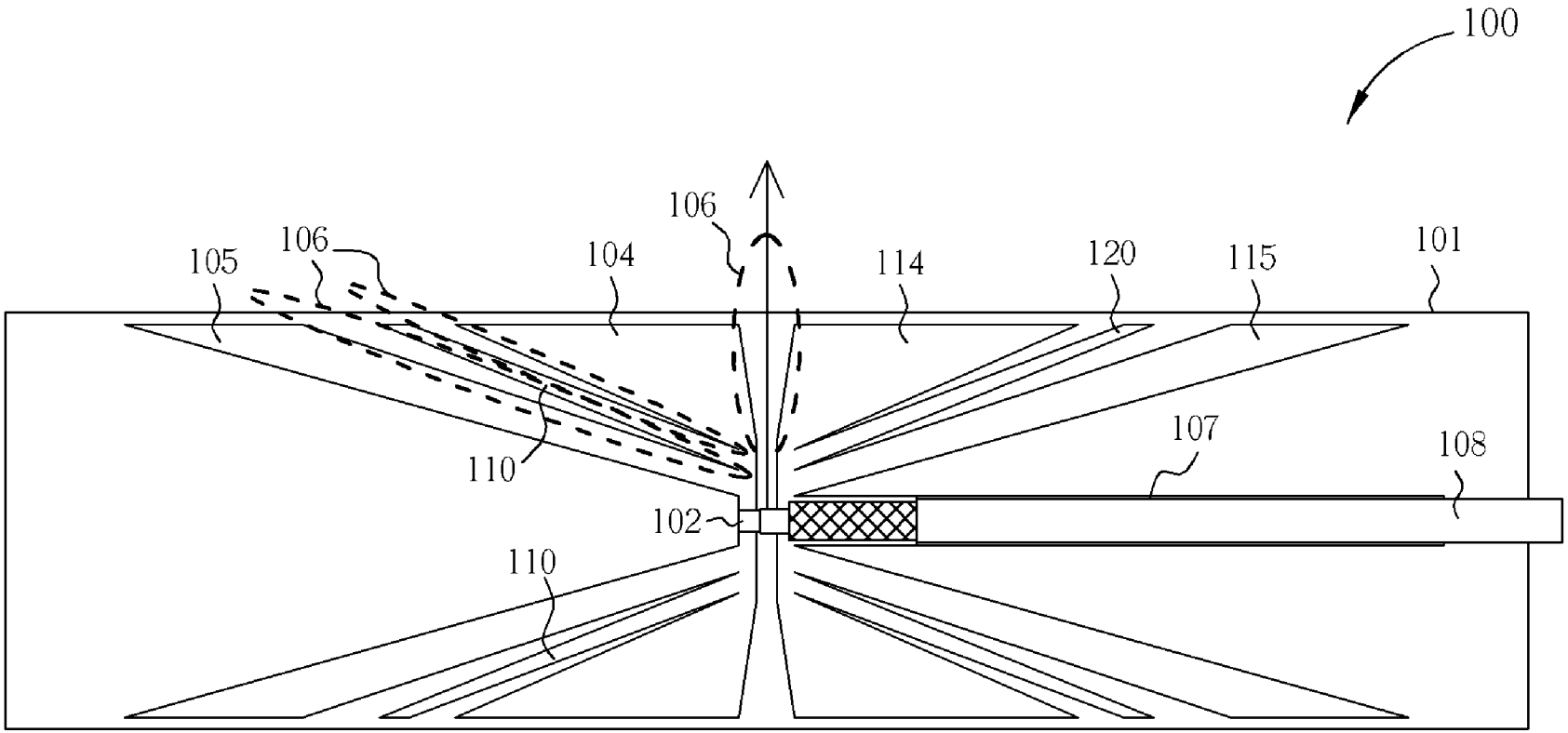
FIG. 7 is a diagram of a triple-frequency variation of the antenna of FIG. 1.

There are also wedge-shaped gaps 6, 16 exposing the substrate, again for impedance matching, disposed along the vertical axis between the radiating traces 4 and the ground traces 14. Shown in FIG. 1 but optionally included, as shown in FIG. 7, is a wedge-shaped directional trace 3 disposed along the vertical axis on each side of the horizontal axis, a narrowest end of each directional being nearest the feed point. Inclusion or exclusion of the optional directional trace 3 is subject to design considerations. The antenna 10 can be become functional with the attachment of a feeding cable 8 of a type well known in the art, having a central core conductor fixed to the feed point 2 and an outer shell conductor fixed to the ground area and/or ground strip 7.

Figure 2:
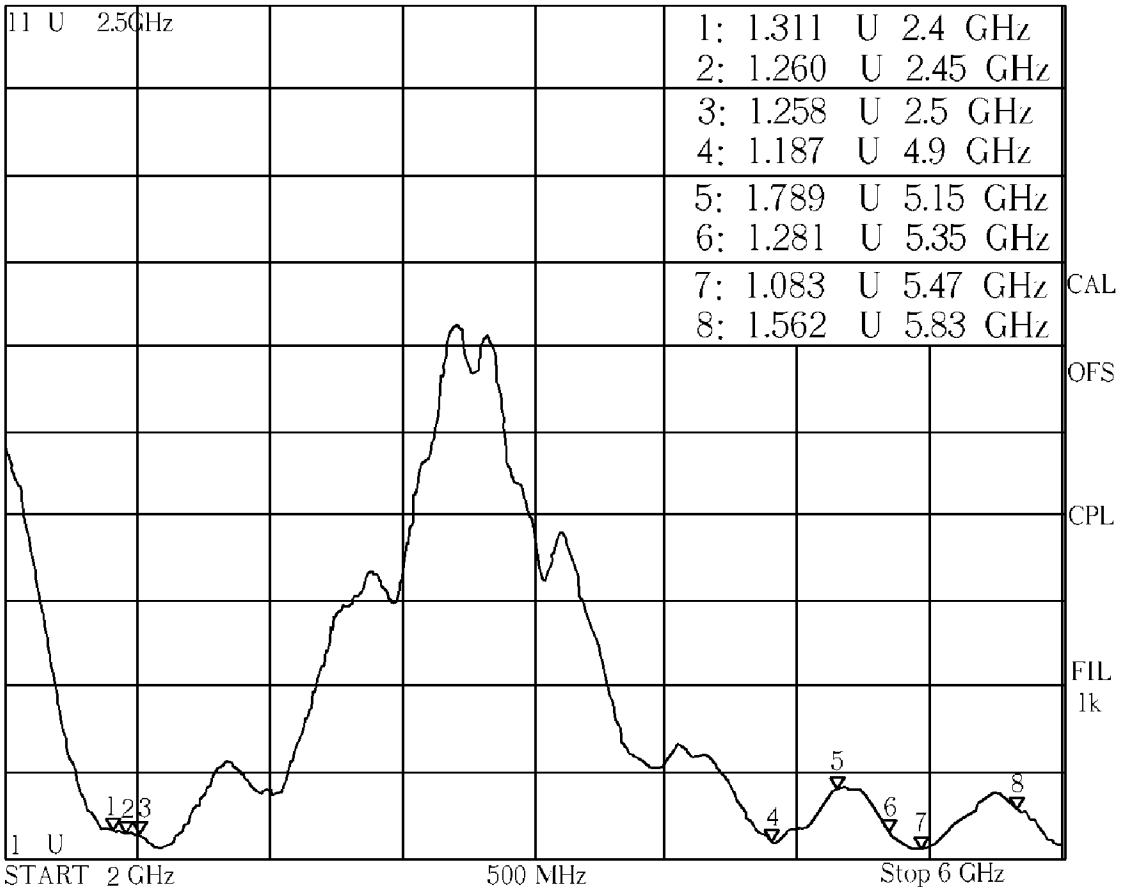
FIG. 2 is a graph showing performance of the antenna of FIG. 2.
Figure 3:
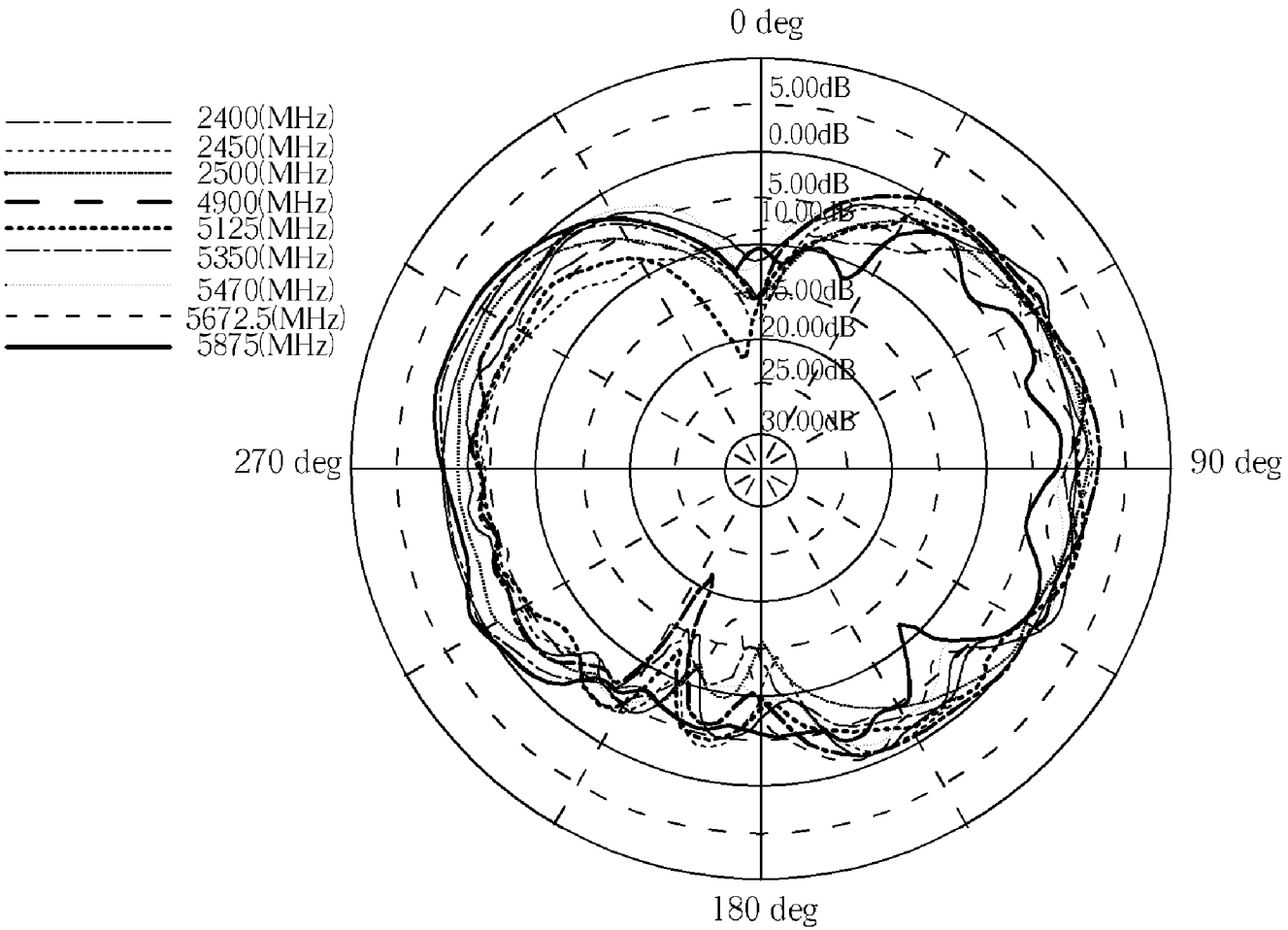
FIG. 3 to FIG. 5 show the radiation pattern of the antenna of FIG. 1 in XZ, YZ, and XY plane perspectives.
Figure 4:
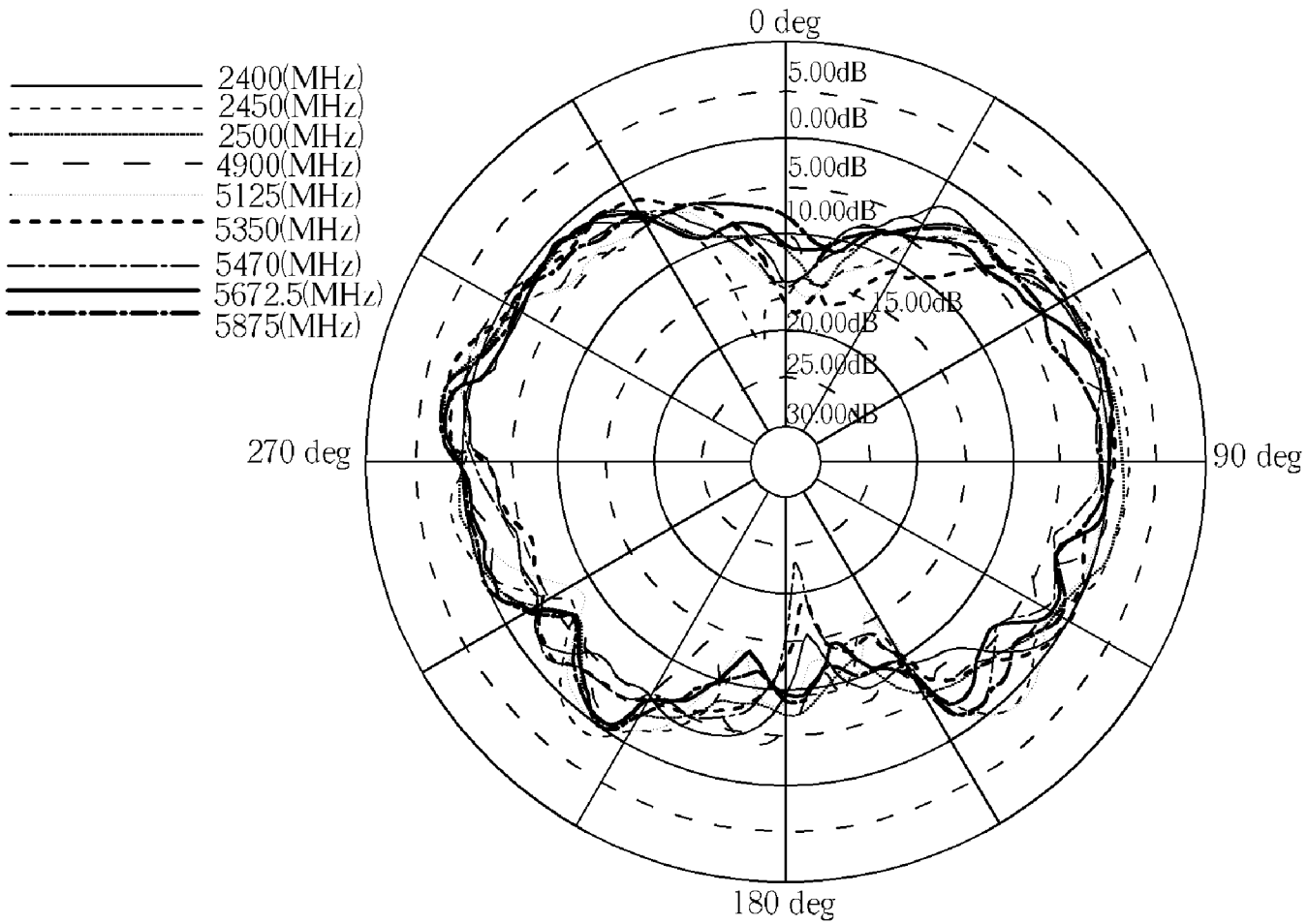
Figure 5:
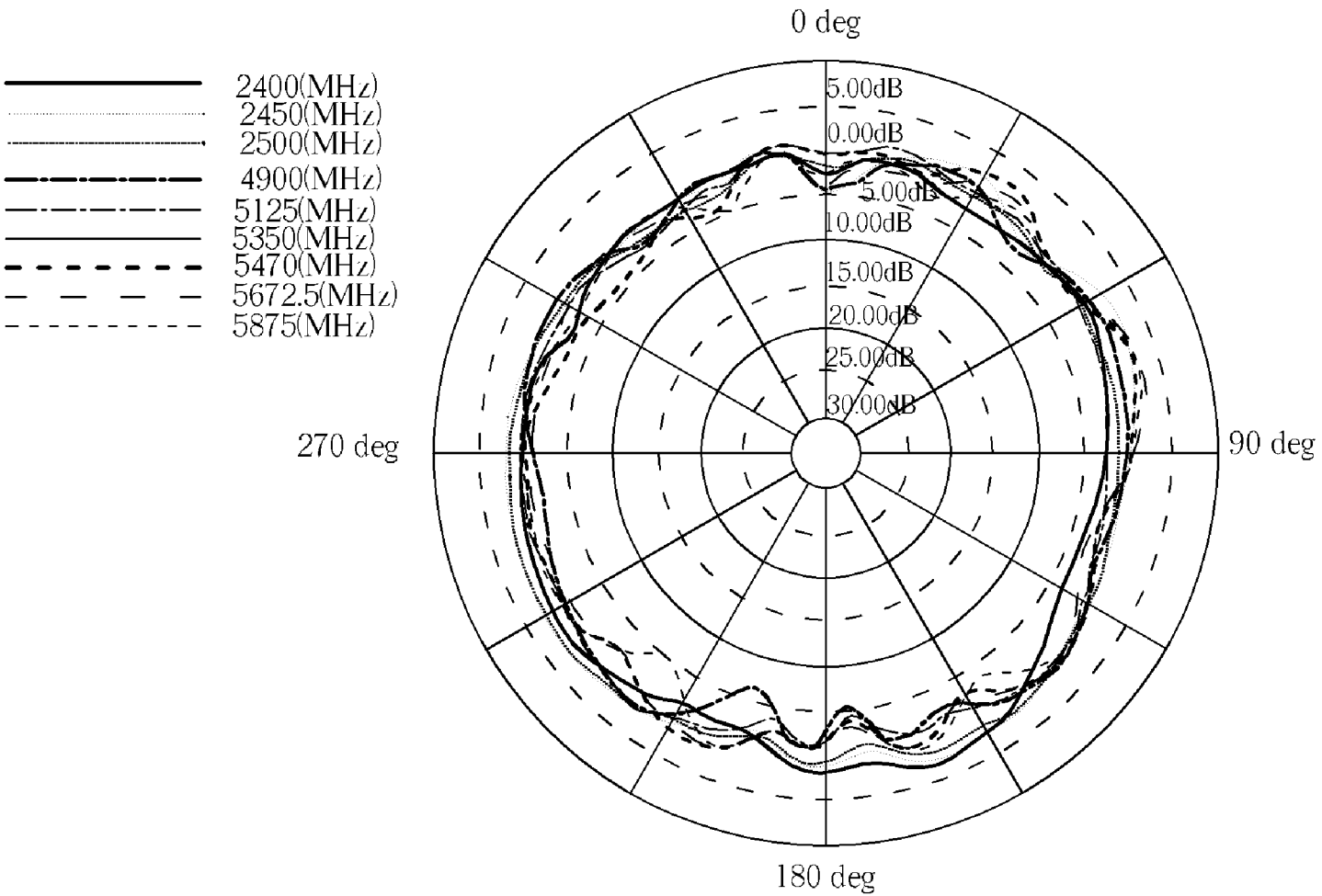
Figure 6:
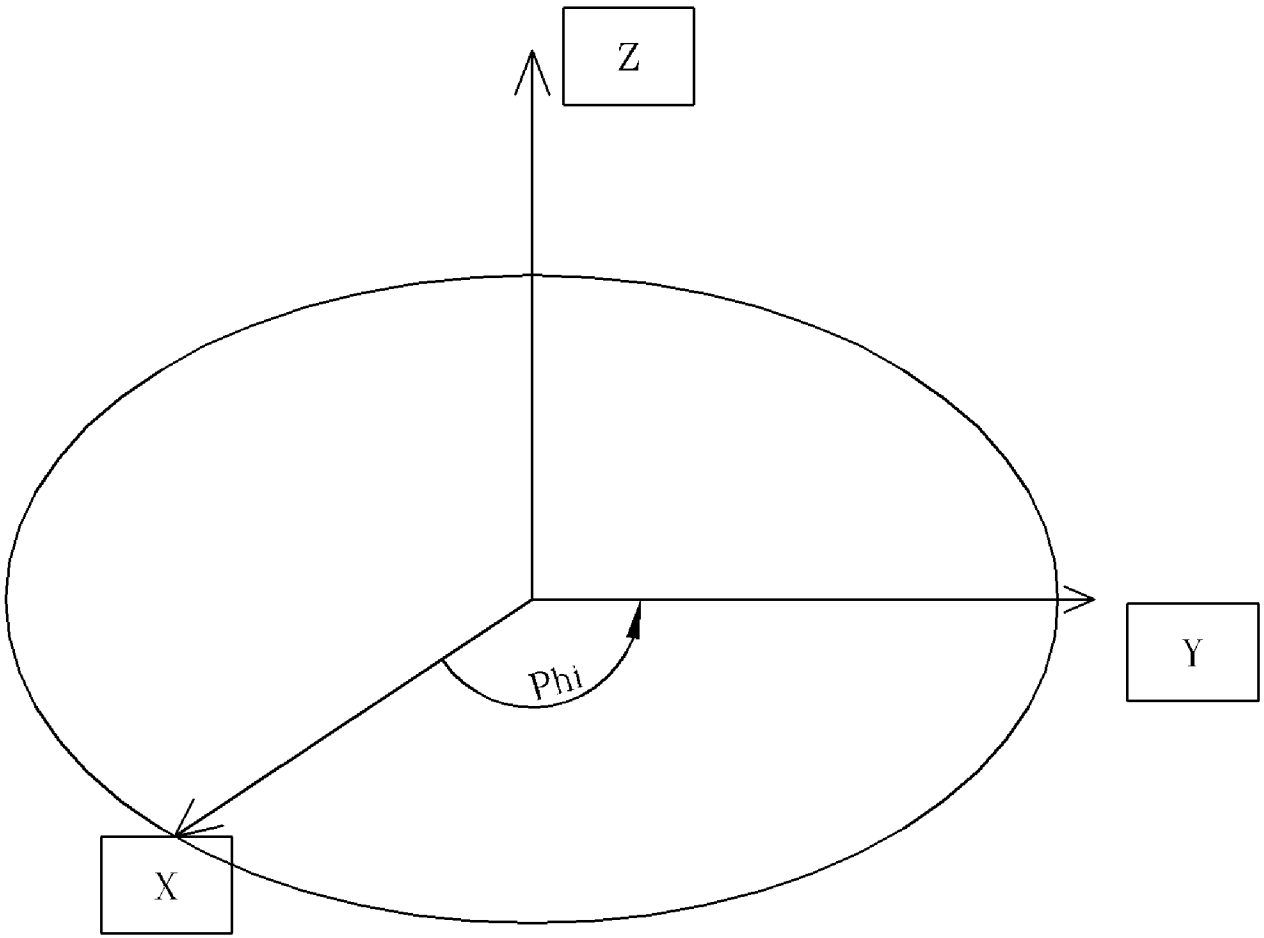
FIG. 6 shows the Phi characteristics of the antenna of FIG. 1 producing the radiation patterns shown in FIGS. 3-5.

FIG. 2 which is a graph illustrating the frequency performance of the antenna 10. The vertical axis of the graph represents the VSWR and the horizontal axis represents frequency. As can be seen by points labeled 1-8, the antenna 10 exhibits a VSWR of less than 2 for each of the bandwidths of 2.25-2.85 GHz and 4.50-6.00 GHz. As is known, a VSWR of less than 2 is normally considered efficient enough to be acceptable for a specific bandwidth. FIG. 3, FIG. 4, and FIG. 5 illustrate the radiation pattern of the antenna 10 in the XZ plane, the YZ plane, and the XY plane respectively and demonstrate excellent omni-directional performance fo the claimed invention. FIG. 6 illustrates the Phi direction during the transmissions shown in FIG. 3, FIG. 4, and FIG. 5. Please note that the illustrated frequency bandwidths are subject to design considerations and are not to be considered limiting the scope of the invention as a multiple-frequency antenna according to the present invention can easily be designed to function acceptably utilizing alternate bandwidths.

Please refer now to FIG. 7 illustrating another antenna 100, which is a modification of the antenna 10. The antenna 100 comprises a dielectric substrate 101, feed point (and feed area) 102, a variable ground strip (and ground area) 107, radiating traces 104, 105 electrically connected to the feed point 102, and ground traces 114, 115 electrically connected to the ground strip 107, and gaps 106. FIG. 7 also shows a feeding cable 108 connected to the feed point 102 and the ground strip 107.

Arrangement and functionalities of the above-named components of the antenna 100 are similar to those of the antenna 10, with minor differences. For example, radiating trace 104 corresponds to radiating trace 4 and ground trace 115 corresponds to radiating trace 15. The major differences between the antenna 100 and the antenna 10 is a slight change in previous frequency bandwidths and the addition of a third set of radiating traces 110 facilitating a third frequency bandwidth. Like the radiating traces 104, 105, radiating traces 110 are formed on the left side of the vertical axis and are arranged symmetrically with respect to the horizontal axis as shown; with one radiation trace 110 symmetrically disposed on each side of the horizontal axis. Like the other radiating traces 4, 5, 104, 105, each radiating trace 110 is wedge-shaped, tapered such that a narrowest end of each radiating trace 110 is nearest to, and attached to, the feed area. FIG. 7 is illustrated without the optional directional trace 3, but another embodiment of the antenna 100 would include it.

Figure 8:
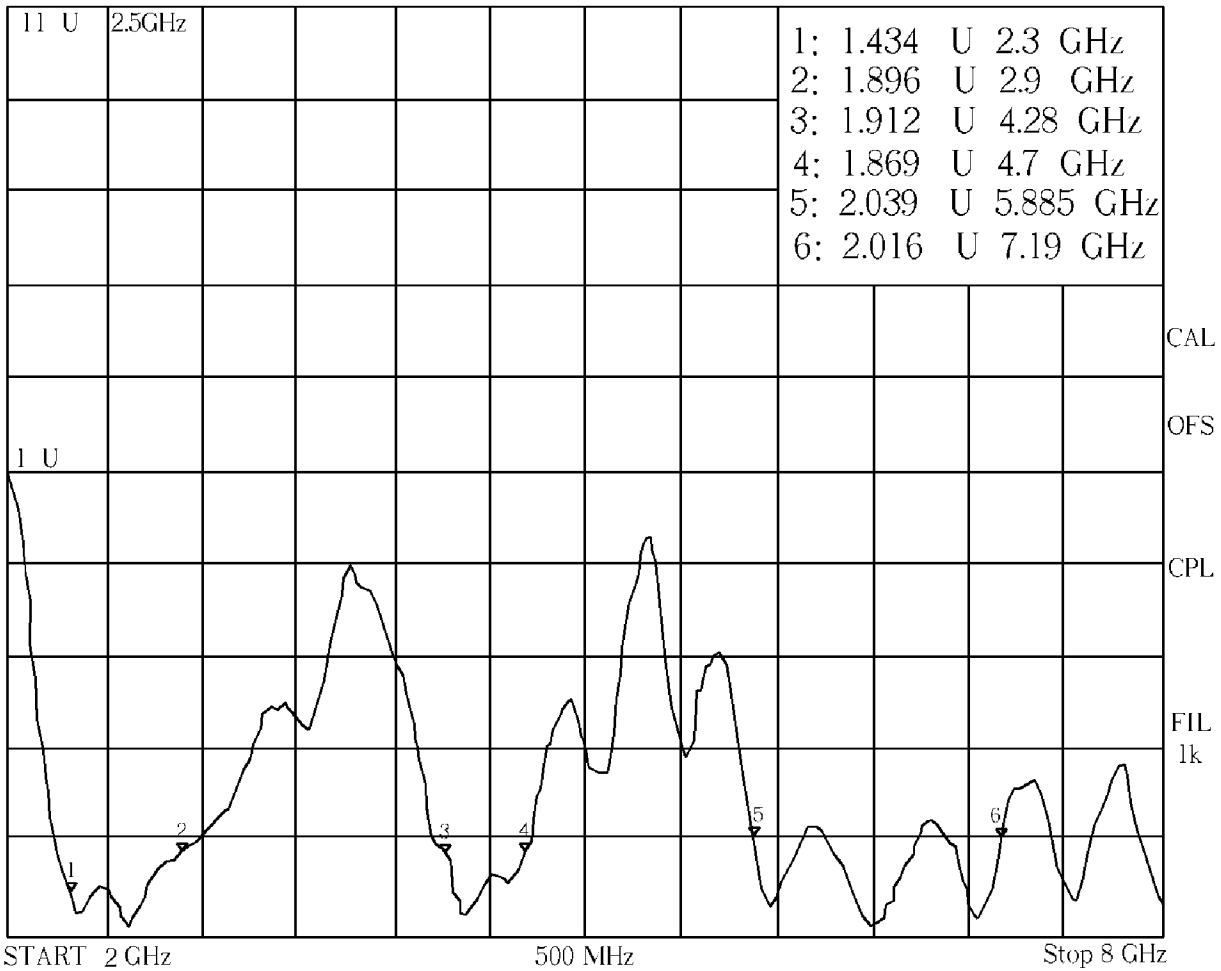
FIG. 8 is a graph showing performance of the antenna of FIG. 7.

FIG. 8 is a graph illustrating the frequency performance of the antenna 100. The vertical axis of the graph again represents the VSWR and the horizontal axis represents frequency. As can be seen by points labeled 1-6, the antenna 100 exhibits a VSWR of less than 2 for each of the bandwidths of 2.25-2.9 GHz, 4.30-4.70 GHz, and 5.80-7.2 GHz and as such is normally considered efficient enough to be acceptable for the stated bandwidths. Again, please note that these specific bandwidths are subject to design considerations and are not to be considered as limiting the scope of the present invention. The antenna 100 exhibits omni-directional performance similar to that shown in FIG. 3 to FIG. 6.

Figure 9:
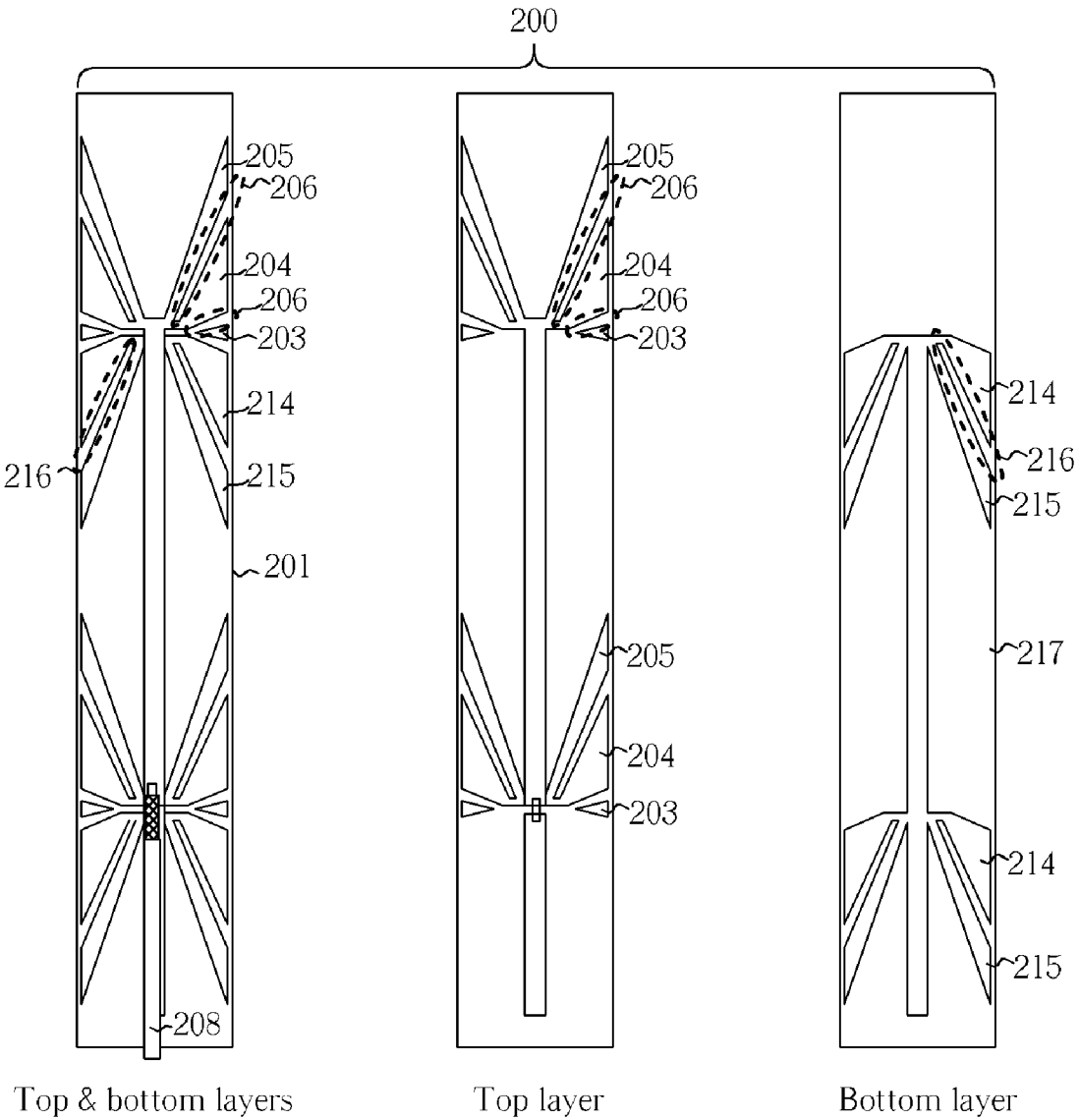
FIG. 9 is a diagram showing one possible array of antennas of according to the present invention.

FIG. 9 shows one method of forming an array 200 of antennas according to the present invention to further enhance gain if desired. The array 200 comprises a plurality of symmetrically arranged antennas formed on a single dielectric substrate 201; each antenna having the same symmetries as the antenna 10. Each antenna of the array 200 comprises a plurality of wedge-shaped and symmetrically arranged radiating traces 205, 204, gaps 206, 216, and ground traces 214, 215. As before, the antennas of the array 200 optionally may or may not comprise wedge-shaped directional traces 203 according to design considerations. Additionally, although not shown, each antenna in the array 200 could have a third (or more) radiating trace as disclosed in the discussion about FIG. 7 if a third frequency bandwidth is desired.

The preferred relative arrangement of components of the individual antennas in the array 200 does differ in a single feature from the disclosed arrangement of components in the antenna 10. In the antenna 10, all components are normally, but not necessarily, formed on a single surface of the substrate 1. However, due primarily to manufacturing concerns, although all components of the array 200 could be formed on a single surface of the substrate 201 in another embodiment, it is easier to form all radiating traces 205, 204 on one side of the substrate and all ground traces 214, 215 formed on the other side of the substrate, such that the substrate lies in-between the layer of radiating traces and the layer of ground traces. This is best illustrated in FIG. 9 which shows the layer (Top Layer) of radiating traces 205, 204, the layer (Bottom Layer) of ground traces 214, 215, and an X-ray view of the top and bottom layers combined. Please note that a conductive strip now electrically connects the feed point of the radiating traces 205, 204 of one antenna with the feed point of the radiating traces 205, 204 of an adjacent antenna, and the ground strip has been altered to connect the ground areas of adjacent antennas, allowing simple connection of all antennas in the array 200 with a single feeding cable 208.

As disclosed above, the present invention teaches a new multiple-frequency antenna made small and compact by utilizing wedge-shaped components, giving the overall antenna a symmetrical"butterfly" or "V" shape. The wedge-shaped, or tapered polygonal component structure enables better impedance matching and demonstrates better bandwidth characteristics in a multiple-frequency antenna. A printed circuit is utilized for components giving high repeatability. Excellent omni-directional radiation patterns, high gain performance, and a wide impedance or VSWR bandwidth is achieved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A planar multiple-frequency antenna comprising:

a dielectric substrate having a horizontal axis and a vertical axis perpendicular to the horizontal axis;

a feed point disposed along the horizontal axis on a first side of the vertical axis;

a ground strip disposed along the horizontal axis on a second side of the vertical axis opposite the feed point;

a plurality of wedge-shaped radiating traces arranged symmetrically with respect to the horizontal axis disposed on the first side of the vertical axis, a narrowest end of each radiating trace being nearest the feed point;

a plurality of wedge-shaped ground traces symmetrical to the plurality of radiating traces with respect to the vertical axis disposed on the second side of the vertical axis; and a wedge-shaped gap exposing a surface of the substrate between each of the radiating traces for impedance matching, a narrowest end of each gap being nearest the feed point.

2. The multiple-frequency antenna of claim 1 further comprising a wedge-shaped directional trace disposed along the vertical axis on each side of the horizontal axis, a narrowest end of each directional being nearest the feed point.

3. The multiple-frequency antenna of claim 2 wherein the directional trace covers a portion of a wedge-shaped gap exposing the surface of the substrate between the radiating traces and the ground traces.

* * * * *